United States Patent [19]

Volke et al.

[11] 4,208,138

[45] Jun. 17, 1980

[54] DOT MATRIX PRINTER HEAD

[75] Inventors: Hans-Werner Volke, Salzkotten; Juergen Hilkenmeier, Schloss Neuhaus, both of Fed. Rep. of Germany

[73] Assignee: Nixdorf Computer AG, Paderborn, Fed. Rep. of Germany

[21] Appl. No.: 894,723

[22] Filed: Apr. 10, 1978

[30] Foreign Application Priority Data

Apr. 18, 1977 [DE] Fed. Rep. of Germany ..... 2717077

[51] Int. Cl.[2] ..... B41J 3/12

[52] U.S. Cl. ..... 400/124; 101/93.05

[58] Field of Search ..... 400/124; 101/93.05

[56] References Cited

FOREIGN PATENT DOCUMENTS 2119641 11/1972 Fed. Rep. of Germany ..... 400/124
2256813 5/1973 Fed. Rep. of Germany ..... 400/124
2420005 11/1974 Fed. Rep. of Germany ..... 400/124

*Primary Examiner*—Paul T. Sewell
*Attorney, Agent, or Firm*—Gifford, VanOphem, Sheridan & Sprinkle

[57] ABSTRACT

A dot matrix printer with a plurality of armature magnet units mounted on a printer head bracket, each armature magnet unit having an armature with a printing needle attached at one end and pivotally secured to a magnet yoke shank at the other end by one end of a U-shaped spring bracket. The spring bracket fits around the magnet yoke and the other end of the spring bracket is secured to a guide piece for limiting the stroke of the armature end carrying the printing needle.

10 Claims, 4 Drawing Figures

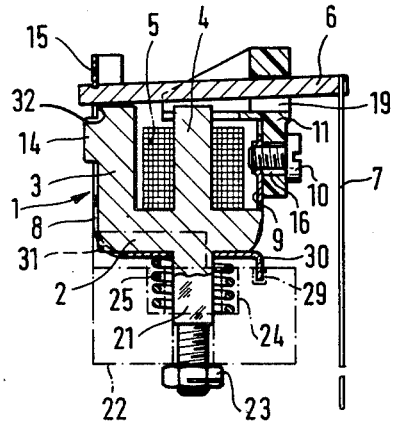
FIG. 1
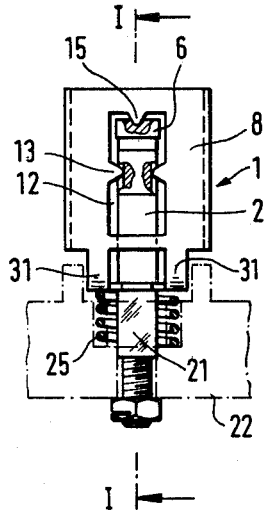
FIG. 2
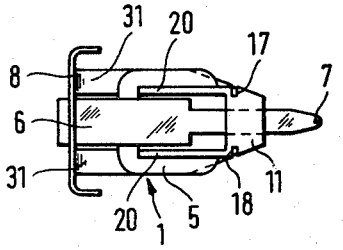
FIG. 3
FIG. 4
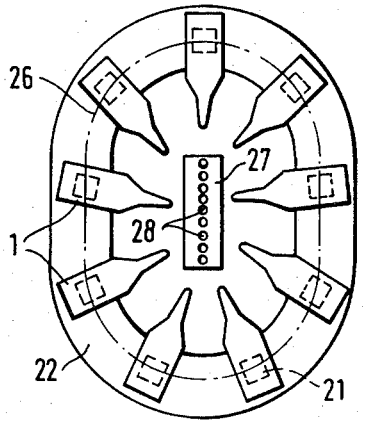

DOT MATRIX PRINTER HEAD

BACKGROUND OF THE INVENTION

I. Field of the Invention

The invention consists of a Dot Matrix Printer Head having the printer needles attached to the armatures of a plurality of armature type magnets by which the needle carrying ends of the armatures culminate at the height of a common needle guide.

II. Description of the Prior Art

In previously known matrix printer head designs, the individual printing needle carrying armatures are rigidly attached to the magnet yoke brackets or located in a housing so that the needle carrying armatures are directly attached to one shank of a magnet yoke in a swiveling manner, and the other magnet yoke shank is used as a stroke limiter for the needle carrying armature. The printer head also serves as a housing carrying all the armature type magnets.

Dampening attachments are provided for the magnet core (yoke) shanks as well as for the corresponding impact areas of the housing (see publication: Deutsche Offenlegungsschrift No. 2 110 410). This is the way the common yoke structure for all the armature type magnets is designed which consists of two concentric pots made in one piece between which the cylinder form coils are located. On the walled printing side of the core pot, a concentric shock absorbing washer is provided which is made of elastic material. In another known design (see publication: Deut ches Gebrauchsmuster No. 70 42 714) provision is made for screw adjustable pins made of synthetic material and installed in a common cover which encloses all the armature type magnets; at their resting position, the armatures are blocked by those pins. The pins are adjustable in accordance with the working stroke of the printing needles. All these known arrangements have the disadvantage of lacking means to improve recoil phenomena. This is particularly due because of the common housing for the armature type magnets which is being provided for direct or indirect impact and also because these systems contain a relatively large number of components. The relatively bad recoil behavior does not provide a high limit of working frequencies with these known printer heads. Furthermore, the assembly of such printer heads, which are composed of many parts, is relatively complicated and elaborate.

SUMMARY OF THE INVENTION

The main purpose of the present invention is to increase the working efficiency and, particularly, the working frequency of the printer head through a simple design arrangement introduced in the mentioned art. To do this, and to obviate the above-mentioned disadvantages, the invention provides a single spring bracket for the magnet yoke and coil on one hand and the guide and bearing elements for the magnet armature on the other. According to a preferred arrangement of the invention, a shock absorbing guide piece is attached at the elastic end of the spring bracket, is preferably made of synthetic material, and it serves as a stop for the end of the armature opposite to the pivot bearing of the armature. By this at least partially guiding type arrangement of the printing element carrying portion of the armature, located at the spring support attached to the magnet yoke, a bounce free recoil of the armature is particularly accomplished. The spring support, by its proper elasticity, thus dampens recoil and, furthermore, carries the parts which are designed to limit the working stroke of the armature.

For this purpose particularly, the guide piece which is located at the free end of the spring bracket is preferably made of synthetic material. The spring bracket which is connected to the magnet yoke with an elastic material, namely the spring bracket itself, is useful to achieve an uncoupled connection, substantially so that the mechanical shocks on one hand produced during the printing process can be fully absorbed and, in any case, these shocks are prevented from being transmitted to the bracket, housing etc. With this arrangement of the invented dot matrix printer head, extremely high limits of working frequencies can be achieved and a very high degree of efficiency can be attained.

According to a further arrangement of the invention, the guide piece also provides a lateral guidance of the armature by means of lateral guide pieces. Thus, stroke limiting and lateral side guidance pieces are made out of one piece which can be easily produced and assembled rapidly.

Preferably, the stroke limiting guide piece is mounted to the spring bracket in an adjustable manner, preferably by a slot and screw arrangement.

Another feature of the invention is that the U-shaped spring bracket is designed to carry the guide piece on one end, and the other end of this bracket carries the counter bearing of the armature, preferably in the form of a point which presses the armature against a shank of the magnet yoke at the height of the pivoting bearing. This arrangement eliminates the need for special bearing elements which would be required to be attached to the magnet yoke or its shanks. The single spring bracket forming a pivoting bearing feature allows for a constant and very tight fit of the armature yoke to the armature, eliminating the detrimental effects of an air gap in the path of the magnetic flux.

Furthermore, the use of the spring bracket as part of the pivoting bearing enables the armature, when actuated, to be maintained in the open position, thus eliminating the need for additonal parts for the armature recoil stop. The assembly work can, therefore, be sensibly reduced because the spring bracket and the magnet yoke are held together through a notching arrangement.

In known printing systems, several armature type magnets, whose armatures carry the printing needles at the free ends overreaching each of the magnet yokes, are mounted in a circular pattern in order to communicate with a needle guide. The needle guidance system contains straight, adjacently disposed guide channels for each individual printing needle. The result is that the distances between the attachment points of the needles on the armature and their guidance channels are different. This requires that the individual needles have to be made of different lengths. After completion of the assembly of such a system, the needles must be subjected to a finishing process, i.e., they must be polished so that they remain in the same plane. Having different distances between the needles attachment points and the needle guide results in different friction ratios between the individual needles and also different feed through flexion of the needles. This has an unfavorable effect on the working frequencies of the printer heads.

According to the present invention, the armature type magnets are arranged in a noncircular pattern on the printer head bracket. A plurality of guide channels, preferably arranged in a straight line form a needle guide. The armature type magnets are disposed on the printer head bracket on a path which resembles an ellipse surrounding the needle guide, i.e., the guide channels arranged on a straight line.

In this manner it is assured that the distances between the attachment points and their corresponding guide channels are, at least substantially, equal, which results in largely equal friction ratios and feed through flex for all printing needles.

The subject invention of the dot matrix printer head can be adjusted for short and long stroke as well as for extremely high speed operation which, in any case, increases the working efficiency over other known designs.

BRIEF DESCRIPTION OF THE DRAWINGS

The invention is better understood by reference to the attached drawing and a description of the design example.

Shown is:

FIG. 1 is a cross-sectional elevation of a single armature type magnet of the present invention taken substantially along line I—I in FIG. 2;

FIG. 2 is a side plan view of a single armature type magnet of the present invention;

FIG. 3 is a rotated top plan view of the armature type magnet shown in FIG. 2;

FIG. 4 is a top plan view of an assembled printer head of the present invention in schematic form.

DETAILED DESCRIPTION OF THE INVENTION

The armature type magnet 1 shown in FIGS. 1 to 3 comprises a U-shaped sintered metal magnet yoke 2, having two shanks 3 and 4, shank 4 having a coil 5 wound around it, and a sintered metal armature 6 carrying a printing needle 7 at its free end. A U-shaped spring bracket 8 extends around the periphery of magnet yoke 2 and, finally, guide piece 11 is attached with a screw 10 at the free and flexible end 9 of part 8. Guide piece 11 is made of synthetic material. Spring bracket 8 is made of elastic material, such as spring steel for example, and has a notched aperture 12 as well as notched element 13 which engages with projections such as 14, for example, of the magnet yoke. Furthermore, spring bracket 8 has an insertion tab 15 which engages by spring pressure in a groove located in armature 6 to provide a single point contact so that the end of armature 6 presses against the free end of magnet yoke 2, at shank 3, at its sloped surface 32. At the opposite end of yoke shank 3 of magnet yoke 2, the U-shaped spring bracket 8 is curved so that shank end 9 of spring bracket 8 runs parallel to yoke shank 3. A threaded bore in shank end 9 is shown which is used to fasten guide 11 to shank end 9 through a slot in guide 11 with screw 10. As shown in FIG. 3, guide piece 11 has slots at its two opposite limiting ends which engage two short tabs 18 extending from spring bracket 8. Adjustment and blocking of guide piece 11 is made by groove and spring guide arrangement. Guide piece 11 has an aperture 19 through which armature 6 can pass. The top limiting portion of aperture 19 acts as a stroke limiter for armature 6. Furthermore, guide piece 11 is equipped with lateral guides 20 made in one piece, with a spread between them to match the width of armature 6. Finally, guide piece 11 has an opening around which guide pieces 11 and 20 are connected together with a bottom piece in which they are being guided at the yoke shank 4.

Magnet yoke 2 has a square section journal 21 which passes through spring bracket 8 and is provided with a threaded extension. The entire printer head magnet 1 is inserted into the printer head bracket 22 with the bottom part of journal 21 extending through a square opening in bracket 22 and fastened to bracket 22 by nut 23. A pressure spring is located in a cavity 24 in the printer head bracket 22 and enclosed by the spring bracket 8, which allows vertical adjustment of armature magnet 1 with respect to printer head 22.

As it is clearly shown on FIG. 1, spring bracket 8 rests only on its bottom part and at the mentioned notched places 12, 13 at the magnet yoke 2. This type of suspension allows for a tight metal to metal mounting at the magnet yoke and permits a very good spring damping effect for spring bracket 8.

As it is clearly shown in FIG. 4, the printer head magnets are arranged along an ellipse shaped curve 26 which follows the elliptical shape of printer head bracket 22, in the center of which is located a needle guide 27 provided with several channels, each channel corresponding to and adapted to receive an individual printing needle 7 of the printing magnets.

Since armature 6 is pressed against the free end of magnet yoke shank 3 by bearing tongue (tab) 15, there is no air between magnet yoke 2 in the area of the pivoting point and therefore practically no magnetic flux losses. Furthermore, guide piece 11 for armature 6 acts as an exact guide as well as a stroke limiter for the armature. This guide piece, due to the elasticity of the spring bracket 8, to which it is secured provides a very good dampening of the armature recoil and is also beneficial for the adjustment of the stroke of armature 6. This permits reduction of the moving mass of armature 6 and reduction of the size of its end, as it is specially shown on FIG. 3. Furthermore, the armature is somewhat thinner and wider than the yoke and has, therefore, the same cross sectional area. This arrangement allows capture of the stray magnetic flux around the poles of magnet yoke 2.

By using identical parts for short and long stroke, each armature type magnet is rapidly mounted and dismounted from printer head bracket 22. Preferably, the threaded nut 23 is provided with a self locking device. In order to avoid angular shift of printer head magnet 1 with respect to printer head bracket 22, the latter is provided with indentations 29 in which a tab 30 on bracket 8 is inserted. Furthermore, journal 1 has a rectangular cross section and is located in a recess of corresponding shape in the printer head bracket. According to the arrangement of the individual printer head magnets 1 on the printer head bracket 22, shown in FIG. 4, practically all the printer head magnet needles 7 have equal friction ratios in the guide channels 28 as well as small and equal feed through flexion in channels 28. Furthermore, this arrangement permits the use of short needle lengths, resulting in high resonance frequencies of needles 7 and reduction of their mass.

The needles are rigidly mounted on armatures 6, e.g., by soldering, gluing, spraying of synthetic material, sintering, crimping, or other methods of fastening. When coil 5 is electrically energized, a magnetic flux path is created in the magnetic yoke 2 which closes itself around armature 6. This causes armature 6, shown in FIG. 1, to be attracted to yoke 2. The spring bracket 8 is stressed through the tilting movement of armature 6 at the slanted portion 32 and this force effects a spring force action. To counteract this force, a spring force is transmitted to the bent parts 31 of spring bracket 8, shown in FIG. 1 to 3. These lower bent portions 31, as can be seen, are spaced apart and adjacent the sides of yoke 2 and, therefore, are able to exercise a spring action with respect to the lower horizontal portion of spring bracket 8. Bracket 8, therefore, shifts in a slight lateral movement at the magnet yoke in its longitudinal direction. This movement, takes place within the dimensional tolerances of notched elements 13 and 14. When the electrical current is interrupted, a recoil movement takes place, due to bent parts 31 which exercises a downward directed attractive force on armature 6 at 15 as the latter part swings upwards.

Armature 6, through the above-described motion, forms a double arm lever relative to the forces acting upon it. One lever arm is located between the slanted portion 32 and the anchor point of printing needle 7, the other lever arm, substantially shorter, is located between the slanted portion 32 and the bearing tab 15. This very short length of the latter lever arm permits a relatively large stroke of armature 6 at the slightest spring deformation.

We claim:

1. A dot matrix printer head having a printer head bracket and a plurality of armature magnet units mounted on the printer head bracket, each armature magnet unit comprising:

a U-shaped magnetic yoke having two substantially parallel shanks, each shank having a free end and a leg connecting the other ends of the shanks together, an elongated armature disposed across the free ends of said shanks, said armature having a printing needle secured to one end, a U-shaped spring bracket positioned aroung the leg of said magnetic yoke, said spring bracket having one end which engages the other end of the armature adjacent the free end of one shank and pivots said armature against said last mentioned shank and away from the free end of the other shank, and a guide piece disposed at least partially around said armature to thereby limit its pivotal movement, whereby elastic deformation of the spring bracket enables said armature to pivot about said one shank.

2. The invention as defined in claim 1 wherein said guide piece is secured to the other end of said spring bracket.

3. The invention as defined in claim 2 wherein said spring bracket includes a generally V-shaped tab which engages said other end of said armature.

4. The invention as defined in claim 2 wherein said guide piece is constructed of a synthetic material.

5. The invention as defined in claim 2 and further comprising a journal integrally formed with said magnetic yoke and extending outwardly from said connecting leg and through an opening formed in the spring bracket.

6. The invention as defined in claim 2 wherein said spring bracket further comprises a pair of facing locking tabs which engage slots formed in said one shank which run parallel to the length of said one shank.

7. The invention as defined in claim 2 wherein said guide pieces includes a slot and wherein said guide piece is secured to said spring bracket by a screw extending through said slot and engaging a threaded bore in the spring bracket, the length of the slot in the direction parallel to the axes of the shank being greater than the diameter of the screw whereby said guide piece is adjustably secured to said spring bracket.

8. The invention as defined in claim 2, wherein the spring bracket has an opening substantially equal in width to the thickness of the magnet yoke, said opening being formed at the junction of said one shank and said connecting leg, said opening forming a pair of connecting cross bridges on the spring bracket, said cross bridges being elastically deformed upon activation of the armature magnet unit.

9. The invention as defined in claim 2 wherein the guide piece is made of shock absorbing material.

10. The invention as defined in claim 9 wherein the guide piece is provided with lateral guide pieces for guidance of said armature.

* * * * *

UNITED STATES PATENT AND TRADEMARK OFFICE

CERTIFICATE OF CORRECTION

PATENT NO. : 4,208,138

DATED : June 17, 1980

INVENTOR(S) : Hans-Werner Volke and Juergen Hilkenmeier

It is certified that error appears in the above-identified patent and that said Letters Patent are hereby corrected as shown below:

Column 3, line 58, after "slots" insert --17--;

Column 6, line 24, delete "pieces" and insert --piece-- therefor.

Signed and Sealed this

Thirtieth Day of September 1980

[SEAL]

Attest:

SIDNEY A. DIAMOND

Attesting Officer

Commissioner of Patents and Trademark